US006868917B2

(12) United States Patent
Meyer et al.

(10) Patent No.: US 6,868,917 B2
(45) **Date of Patent: *Mar. 22, 2005**

(54) LOW PRESSURE, EARLY SUPPRESSION FAST RESPONSE SPRINKLERS

(75) Inventors: Stephen J. Meyer, Malvern, PA (US); George S. Polan, Perkiomenville, PA (US); James E. Golinveaux, North Wales, PA (US)

(73) Assignee: Central Sprinkler Company, Lansdale, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/313,016

(22) Filed: Dec. 6, 2002

(65) Prior Publication Data

US 2003/0079889 A1 May 1, 2003

Related U.S. Application Data

(63) Continuation of application No. 09/183,990, filed on Nov. 2, 1998, now Pat. No. 6,502,643, which is a continuation of application No. 08/813,780, filed on Mar. 7, 1997, now Pat. No. 5,829,532.

(51) Int. Cl.[7] ..... A62C 37/08; A62C 35/00

(52) U.S. Cl. ..... 169/37; 169/38; 169/39; 169/40; 169/41; 169/16

(58) Field of Search ..... 169/37, 38, 39, 169/40, 41, 16, 28; 239/498, 504, 506, 518, 521, 522

(56) References Cited

U.S. PATENT DOCUMENTS

| | | | |
|---|---|---|---|
| 2,357,227 | A | 8/1944 | Rowley |
| 2,389,334 | A | 11/1945 | Tyden |
| 2,502,754 | A | 4/1950 | Rowley |

(List continued on next page.)

FOREIGN PATENT DOCUMENTS

| | | | |
|---|---|---|---|
| DE | 25 08 355 | A1 | 9/1976 |
| DE | 28 16 369 | A1 | 10/1978 |
| EP | 0 215 331 | A1 | 3/1987 |

(List continued on next page.)

OTHER PUBLICATIONS

U.S. Appl. No. 10/154,845, filed May 28, 2002, Polan et al., Low Pressure Fast Response Bulb Sprinklers.

U.S. Appl. No. 10/154,846, filed May 28, 2002, Meyer et al., Low Pressure, Early Suppression Fast Response Sprinklers.

(List continued on next page.)

*Primary Examiner*—Davis D Hwu

(57) ABSTRACT

A low pressure, early suppression fast response sprinkler includes a generally tubular body having an inlet ends, an opposing discharge end and an internal passageway extending between the inlet and discharge ends with a K factor greater than 16 where the K factor equals the flow of water in gallons per minute through the internal passageway divided by the square root of the pressure of water fed into the tubular body in pounds per square inch gauge. A deflector is coupled with the tubular body and spaced from and generally aligned with the discharge end of the internal passageway so as to be impacted by a flow of water issuing in a column from the discharge end upon activation of the sprinkler. The deflector is configured and positioned to deflect the flow of water generally radially outwardly all around the sprinkler. A closure is releasably positioned at the discharge end of the tubular body so as to close the internal passageway by a heat responsive trigger mounted to releasably retain the closure at the discharge end of the tubular body. The trigger has a response time indices (RTI) of less than 100 meter$^{1/2}$ sec$^{1/2}$. A specific pendent sprinkler with a nominal K factor of 25, an RTI of less than 40 m$^{1/2}$ sec$^{1/2}$ and delivering at least 100 gallons per minute at an operating pressure at or below 20 psig is described.

46 Claims, 3 Drawing Sheets

U.S. PATENT DOCUMENTS

| | | | | | |
|---|---|---|---|---|---|
| 3,525,402 | A | | 8/1970 | Hattori | |
| 3,682,251 | A | | 8/1972 | Livingston | |
| 3,714,989 | A | | 2/1973 | Gloeckler | |
| 3,722,596 | A | | 3/1973 | Livingston | |
| 3,768,736 | A | | 10/1973 | Cox | |
| 3,811,511 | A | | 5/1974 | McCulloch | |
| 3,834,463 | A | | 9/1974 | Allard et al. | |
| 3,888,313 | A | | 6/1975 | Freeman | |
| 3,904,126 | A | | 9/1975 | Allard | |
| 3,998,273 | A | | 12/1976 | Juliano | |
| 4,091,873 | A | | 5/1978 | Werner | |
| 4,099,675 | A | | 7/1978 | Wohler et al. | |
| 4,109,727 | A | | 8/1978 | Job | |
| 4,113,021 | A | | 9/1978 | Werner | |
| 4,136,740 | A | | 1/1979 | Groos et al. | |
| 4,167,974 | A | | 9/1979 | Job | |
| 4,273,195 | A | | 6/1981 | Fischer et al. | |
| 4,279,309 | A | | 7/1981 | Fischer et al. | |
| 4,298,068 | A | | 11/1981 | Bray | |
| 4,343,364 | A | | 8/1982 | Glinecke | |
| 4,359,097 | A | | 11/1982 | Claussen | |
| 4,405,018 | A | | 9/1983 | Fischer | |
| 4,553,603 | A | | 11/1985 | Dwyer | |
| 4,577,544 | A | | 3/1986 | Lee | |
| 4,580,729 | A | * | 4/1986 | Pounder | 239/524 |
| 4,609,047 | A | | 9/1986 | Pieczykolan | |
| 4,619,327 | A | | 10/1986 | Pieczykolan | |
| 4,657,085 | A | | 4/1987 | Jacobsen | |
| 4,739,835 | A | | 4/1988 | Polan et al. | |
| 4,757,865 | A | | 7/1988 | Simons | |
| 4,800,961 | A | | 1/1989 | Klein | |
| 4,893,679 | A | * | 1/1990 | Martin et al. | 169/39 |
| 4,896,728 | A | | 1/1990 | Wolff et al. | |
| 4,901,799 | A | | 2/1990 | Pepi et al. | |
| 4,930,578 | A | | 6/1990 | Barnett et al. | |
| 4,938,294 | A | | 7/1990 | Mohler et al. | |
| 4,957,169 | A | | 9/1990 | Polan | |
| 4,976,320 | A | | 12/1990 | Polan | |
| 4,981,179 | A | | 1/1991 | Klein | |
| 5,020,601 | A | | 6/1991 | Retzloff et al. | |
| 5,036,923 | A | | 8/1991 | Shea | |
| 5,083,616 | A | | 1/1992 | Polan | |
| 5,094,298 | A | | 3/1992 | Polan | |
| 5,109,929 | A | | 5/1992 | Spears | |
| 5,366,022 | A | | 11/1994 | Meyer et al. | |
| 5,511,621 | A | | 4/1996 | Yao | |
| 5,579,846 | A | | 12/1996 | Meyer et al. | |
| 5,584,344 | A | | 12/1996 | Meyer et al. | |
| 5,609,211 | A | | 3/1997 | Meyer et al. | |
| 5,622,225 | A | | 4/1997 | Sundholm | |
| 5,647,438 | A | | 7/1997 | Chatrathi et al. | |
| 5,664,630 | A | | 9/1997 | Meyer et al. | |
| 5,669,449 | A | | 9/1997 | Polan et al. | |
| 5,722,599 | A | | 3/1998 | Fries | |
| 5,810,090 | A | | 9/1998 | Sundholm | |
| 5,810,263 | A | | 9/1998 | Tramm | |
| 5,829,532 | A | * | 11/1998 | Meyer et al. | 169/37 |
| 5,829,684 | A | | 11/1998 | Fishcer | |
| 5,839,667 | A | | 11/1998 | Fishcer | |
| 5,853,215 | A | | 12/1998 | Lowery | |
| 5,862,994 | A | | 1/1999 | Pounder et al. | |
| 5,865,256 | A | | 2/1999 | Pounder | |
| 5,890,657 | A | | 4/1999 | Ponte | |
| 5,915,479 | A | | 6/1999 | Ponte | |
| 5,967,238 | A | | 10/1999 | Pepi et al. | |
| 6,059,044 | A | | 5/2000 | Fischer | |
| 6,082,463 | A | | 7/2000 | Ponte | |
| 6,336,509 | B1 | * | 1/2002 | Polan et al. | 169/37 |
| 6,502,643 | B1 | * | 1/2003 | Meyer et al. | 169/37 |

FOREIGN PATENT DOCUMENTS

| | | | |
|---|---|---|---|
| EP | 0 331 423 | A2 | 9/1989 |
| EP | 0 339 788 | A3 | 11/1989 |
| EP | 0 339 788 | A2 | 11/1989 |
| EP | 0 347 876 | A2 | 12/1989 |
| EP | 1 010 442 | A2 | 6/2000 |
| GB | 409569 | | 9/1934 |
| GB | 1027930 | | 4/1966 |
| GB | 2 120 934 | A | 12/1983 |
| GB | 2 195 241 | A1 | 4/1988 |
| IT | 566782 | | 9/1957 |
| SU | 1768188 | A1 | 10/1992 |
| WO | 93/06891 | A1 | 4/1993 |
| WO | 94/26354 | A1 | 11/1994 |

OTHER PUBLICATIONS

Yao, C., "Applications of Sprinkler Technology—Early Suppression of High–Challenge Fires with Fast–Response Sprinkler," *Fire Safety: Science and Engineering, ASTM STP 882,* T.Z. Harmathy, Ed., American Society for Testing Materials, Philadelphia, (1985), pp. 354–376.

Heskestad, G., Technical Report FMRC Ser. No. 22437 RC79–T–1 "Sprinkler Performance as Related to Size and Design: vol. I—Laboratory Investigation," Factory Mutual Research Corporation, Norwood, MA, (Feb. 1979), 129 pp.

*FMRC Update,* Factory Mutual Research Corp., Norwood, MA, V. 8, No. 2 (1994), pp. 1–4.

NFPA 13 new Technology Task Group, National Fire Protection Association, Quincy, MA (undated), 12 pp.

Loss Prevention Data Technical Advisory Bulletin 2–7, "Viking Corp. 'High Challenge' Extra Large Orifice Sprinkler with Quick–Responding Fusible Element", Factory Mutual Engineering Corp., Norwood, MA, (Dec. 1986), 3 pp.

Hachenburg, P.H., Letter to R.T. Groos of Viking Corp., Factory Mutual Engineering, Norwood, MA, (Dec. 4, 1986), 2 pp.

File Ex643 "Report on Quick Response Sprinkler for Fire Protection Service", Underwriters Laboratories, Inc., (Dec. 17, 1984), 20 pp.

Chicarello, P.J., Technical Report FMRC J.I. 0G0E7.RR "Large–Drop Automatic Sprinklers", Factory Mutual Research Corp., Norwood, MA (Feb. 1982), 78 pp.

Young, R.A., letter re: CEA Sprinkler Research Programme—2nd Series, Fire Offices Committee, Borehamwood, Hertfordshire, (Jan. 21, 1986), 6 pp.

Smith, J.B., Letter to R.T. Groos of Viking Corp., Factory Mutual Research Corp., Norwood, MA, (Sep. 28, 1971), 4 pp.

Dundas, P., Technical Report Protection of Idle Polyethylene Plastic Pallets with Viking Prototype Sprinklers (0.64 in Orifice), Factory Mutual Research Corp., Norwood, MA, (Jan. 1974) 29 pp.

Viking Technical Bulletin "VTB Quick Response High Challenge® Sprinklers", The Viking Corp., Hastings, MI, (Jan. 1988), 2 pp.

Memo from D. Crowley re: Fire Test Results (Jan. 18, 1988) 1 p.

Memo from D. Crowley re: Fire Test Results (Jan. 13, 1988) 1 p.

Loss Prevention Data Technical Advisory Bulletin 2–7, "Viking Corp. 'High Challenge' Extra Large Orifice Sprinkler with Quick–Responding Fusible Element", Factory Mutual Engineering Corp., Norwood, MA, (Nov. 1987), 5 pp.

Large Drop Sprinklers, P.7.4.1, IRI, (Jan. 3, 1983), 2 pp.
Presentation entitled "Who—Cheng Yao; What—Big Drop Sprinkler; Where—FMRC; When—Started in 1970" Minnesota Mining and Manufacturing Co., (1972), 36 pp.
Gross, R.T., Memo, The Viking Corp., Hastings, MI, (Apr. 11, 1984), 5 pp.
Letter from K. Isman, National Fire Sprinkler Association, Inc. to NFSA Engineering and Standards Committee regarding Minutes of Meeting—Sep. 28–29, 1995 (Dec. 6, 1995), 1p.
Letter from K. Isman, National Fire Sprinkler Association, Inc. to NFSA Engineering and Standards Committee regarding Minutes of Last Meeting and Next Meeting Announcement (Jan. 11, 1995), 1p.
Advertisement for Grinnell ESFR–1, 1 p.
NFPA Fire Pump Committee Report, 1 p.
Letter from C. Grant, National Fire Protection Association to K. Serotte, American National Standards Institute (Mar. 10, 1995), 1 p.
Letter from W. Carey, Underwriters' Laboratories, Inc. to A. Cote, National Fire Protection Association (Feb. 22, 1995), 1 p.
Letter from I. Mande, Edwards Systems Technology to A. Cote, NFPA (Feb. 14, 1995), 1 p.
Letter from I. Mande, Edwards Systems Technology to A. Cote, NFPA (May 11, 1994), 2 pp.
Letter from C. Barnett, Automatic Sprinkler Corporation to G. Simmons, National Fire Protection Association (Feb. 23, 1995), 1 p.
C. Barnett, "Chief Delegate's Report on the 21st Meeting of TC21/SC5/WG1", (Nov. 17, 1994), 4 pp.
List of Delegates for Meeting of ISO/TC 21/SC 5/WG 1, 1 p.
Letter from R. Solomon, National Fire Protection Association to Members of the Technical Committee on Water Mist Systems regarding Health Panel Study (Nov. 29, 1994), enclosing Mawhinney, J.R. et al., Potential Health Effects of Water Mist Fire Suppression Systems Characteristics of Water Mist Systems (Oct. 26, 1994), 17 pp., and Report of Initial Meeting of Water Mist Health Panel (Nov. 8, 1994), 2 pp., and Water Mist Health Panel Agenda (Oct. 27, 1994), 3 pp.
Document entitled "Assignments for Answering EPA Questions", 2 pp.
Lake, J., NFSA Engineering & Standards Committee Outside Committee Activity Report, Water Spray Fixed Systems Committee, 2 pp.
Memorandum from R. Martinez to Project Advisory Committee—"Impact of Wet Pipe Fire Sprinkler Systems" regarding PAC Meeting (Mar. 20, 1995), enclosing AWWARF Participating Utilities Fire Sprinkler Sampling Protocol (Mar. 16, 1995), 10 pp., and First Quarterly PAC Comment Response of Boyle Engineering Corporation (Mar. 6, 1995), 4 pp.
NFPA Automatic Sprinkler Committee Report, 3 pp.
New Tech Proposal, Rewrite Items Chapter 1, 2 and 4 (Apr. 7, 1995), 27 pp.
Tables regarding NFPA proposals, 27 pp.
List of members, NFSA Representation On Outside Technical Committees, (1994), 6 pp.
Vandeyar, D., NFSA Engineering & Standards Committee, Outside Committee Activity Report, NFPA 13 Committee, 1 p.
Comments of K. Isman, NFSA on NFPA Report On Proposals, 1995 Fall Meeting (Apr. 7, 1995), 9 pp.
"Reduced Pressure Principle Assembly", AWWA CS511–92, pp. 8–9.
Viking Corporation Quick/Response High–Challenge Sprinkler advertisement, 1 p.
Letter from John B. Ramsey, The Viking Corporation to John Hoffman, Allied Corporation regarding Viking High Challenge Large Drop Sprinklers (Jan. 22, 1987), 1 p.
"Sprinkler Takes Top Honors," *Fire Protection Contractor*, (Sep. 1985), p. 41.
Loss Prevention Data 2–7, "Installation Rules For Sprinkler Systems Using Large–Drop Sprinklers", Factory Mutual Engineering Corp., Norwood, MA, (Mar. 1980), 9 pp.
Groos, R.T., "Le sprinkler a grosses gouttes", *Face Au Risque* No. 197 (Nov. 1983), 6 pp.
Cover page from *Modern Materials Handling*, (Feb. 1986), 1 p.
Advertisement for Weber Electronic Labeling System, 1 p.
"Equipment Application Data, High–Challenge Sprinklers, Application Report: Digital Equipment Corporation", The Viking Corporation, 4 pp.
"The Application Of Fast Response Sprinklers: A Status Report", (Dec. 1984), 6 pp.
Gross, R. T., "The Large Drop Sprinkler—A Better Answer For The High Challenge Risk", (Oct./Nov. 1983), 3 pp.
Letter from D. Lowell, International Paper Company to A. Pillon, Viking Corporation, (Aug. 10, 1983), 1 p.
Memorandum from G.J. Rosicky, General Motors Corporation to C.G. Keele regarding Polyurethane Fire Test (Nov. 23, 1976), 4 pp.
Draft document entitled "Successful Full Scale Fire Tests Of Large Drop Sprinklers", 1 p.
Groos, R.T., "Advantageous Applications Of Fast Response Sprinklers (And Some Not So Advantageous)" (Feb. 1985), pp. 1–11.
Letter from T. O'Herron, Automatic Sprinkler Corp. of America regarding ESFR, (Jul. 24, 1987), 1 p.
Memorandum from T. Groos to A. Pillon regarding High Challenge Quick Respond (Apr. 12, 1985), 1 p.
Loss Prevention Data Technical Data Advisory Bulletin 2–7, "Large Drop Sprinklers", Factory Mutual Engineering Corp., Norwood, MA, 2 pp.
Handwritten memorandum from C. Wilson, Ball Corp. to T. Groos, Viking Corporation, enclosing Memorandum from C. Wilson to L. Grandcolas regarding National Fire Protection Research Foundation (Oct. 9, 1984) and Memorandum from C. Wilson entitled "Early Suppression—Fast Response: A Risk Management Tool for High Challenge Fires", 7 pp.
Water Supply Analysis Graph, 1 p.
Mailer, Factory Mutual System, Norwood, MA, 1 p.
"Sprinkler In Storage Areas: A Comparison Of Standards", Factory Mutual International, 2 pp.
"Large Drop Sprinklers: Getting The Drop On High–Challenge Fires", 2 pp.
Drawing entitled "Frame, Machining" ESFR–1 Sprinklers; Central Sprinkler Company (1 pg.).
Drawing entitled "Deflector" ESFR–1 Sprinklers; Central Sprinkler Company (1 pg.).
Drawing entitled "Nose" ESFR–1 Sprinklers; Central Sprinkler Company (1 pg.).
*FMRC Update,* Factory Mutual Research Corp., Norwood, MA, vol. 8, No. 2 (1994), 4 pp.

Patent Abstracts of Japan; Publication No. 10108918; Apr. 4, 1998.

Patent Abstracts of Japan; Publication No. 10118220; Dec. 5, 1998.

Patent Abstracts of Japan; Publication No. 11057058; Feb. 3, 1999.

Patent Abstracts of Japan; Publication No. 11299921; Feb. 11, 1999.

*Standard for Installation of Sprinkler Systems NFPA 13,* National Fire Protection Association, Quincy, MA, (1994), pp. 13–1 through 13–124.

Meeting Minutes, New Technology Task Group and Working Group Meetings at Underwriters Laboratories, Inc., Northbrook, IL, (Jun. 23–24, 1994), 8 pp.

Meeting Minutes, NFPA 13 New Technology Task Group Special Task Force, Meeting at Underwrites Laboratories, Inc., Northbrook, IL, (Jun. 24, 1994) 4 pp.

Meeting Minutes, NFPA 13 New Technology Task Group Special Task Force, Meeting at National Fire Protection Association, (Aug. 2–3, 1994), 6 pp.

Meeting Minutes (draft), NFPA 13 New Technology Task Group Special Task Force, Meeting at NFPA, (Sep. 13–14, 1994) 2 pp.

Meeting Minutes, National Fire Sprinkler Association, Inc., Engineering and Standards Committee, Meeting at Burlington, VT, (Sep. 22–23, 1994), 15 pp.

Meeting Minutes, NFPA 13 New Technology Task Group, Meeting at Chantilly, VA, (Feb. 23, 1995), 3 pp.

*Sprinkler Technotes,* National Fire Sprinkler Association, Inc., Patterson, NY vol. XVIII, No. 4, (Jul.–Aug. 1995), 4 pp.

*1996 Annual Meeting Report on Proposals,* National Fire Protection Association, Quincy, MA, (Aug. 1995), 693–804 pp.

Meeting Minutes, National Fire Sprinkler Association, Engineering and Standards Committees, Meeting at Reno, NV, (Sep. 28–29, 1995), 14 pp.

*1996 Annual Meeting Report on Comments,* National Fire Protection Association, Quincy, MA, (1996), pp. 172–204.

*NFPA 13 Installation of Sprinkler Systems,* National Fire Protection Association, Quincy, MA, (Jul. 1996), pp. 13–1 through 13–148 plus unnumbered sheets.

M. Puchovsky, "Entering the Next 100 Years of Standardized Sprinkler System Technology", *Sprinkler Age,* American Fire Sprinkler Association, Inc., Dallas, TX, vol. 15, No. 3, (Mar., 1996), pp. 5, 10, 12, 14, 15, 18 and 19.

Fleming, P., "Applications/Limitations of QRS Technology", *Fire Safety Journal 14,* Elsevier Scientific Ltd., Kidlington, Oxford, UK, (1988) pp. 75–88.

Krasner, L.M., et al., Technical Report No. AFWL–TR–71–149, "Fire Protection Study USAF Mobility Program Structures and Large Air Force Warehouses Phase 1", Factory Mutual Research Corp., Norwood, MA, pp: cover, I–vi, 1–51.

Krasner, L.M., et al, Technical Report No. AFWL–TR–72–246, "Fire Protection Study USAF Mobility Program Structures and Large Air Force Warehouses Phase 2", Factory Mutual Research Corp., Norwood, MA, pp: cover, iii–viii, 1–59.

DD Form 1473 for Technical Report No. AFWL–TR–71–149, 2 pp.

Yao, Cheng, Collection of slides entitled "Evolution of Automatic Sprinkler Fire Protection Systems", Factory Mutual Research Corp., Norwood, MA (May 16, 1996), pp. 16.

*FMRC Update,* Factory Mutual Research Corp., Norwood, MA, vol. 12, No. 1 (1998), 4 pp.

*FMRC Update,* Factory Mutual Research Corp., Norwood, MA, vol. 12, No. 2 (1998), 4 pp.

"Which Sprinkler Will Best Protect Your Warehouse?", *Record,* Factory Mutual, Norwood, MA, (Mar.–Apr. 1991), pp. 3–10.

"ESFR: Expanding Applications and Benefits", *Record,* Factory Mutual, Norwood, MA (Jan.–Feb. 1992), 5 pp.

"New Protection Criteria and a Better Platic Pallet", *Record,* Factory Mutual, Norwood, MA (Nov.–Dec. 1992), 4 pp.

"ESFR: Around the World", *Record,* Factory Mutual, Norwood, MA, (Second Quarter 1997), pp. 6–13.

Kung, Hsiang–Cheng, et al., "Early Suppression, Fast Response (ESFR) Sprinkler Protection for 12 m High Warehouses", International Association for Fire Safety, Fire Safety Science Proceedings of the Fifth International Symposium, (Mar. 19, 1997), 12 pp.

Nam, Soonil, "Development of a Computational Simulating the Interaction Between a Fire Plume and a Sprinkler Spray", reprint from *Fire Safety Journal 26,* Elsevier Sciences Ltd. (1996), pp. 1–33.

Mangan, Joseph F., "ESFR Sprinklers: Advances in Fire Protection", reprint from *Best's Underwriting Newsletter,* A.M. Best Co., Oldwick, NJ, vol. 19, No. 2, (Feb. 1990), 4 pp.

"ESFR: Expanding Applications and Benefits", Factory Mutual Research Corp., Norwood, MA (Feb. 1992), 6 pp.

Wilcox, W.E., "Early Suppression, Fast Response Sprinklers Reduce Losses", *Consulting–Specifying Engineer,* (Apr. 1990), 4 pp.

Casaccio, E.K., "Sprinkler Technology Research", *Sprinkler Age,* (Feb. 1990), cover and 3 pp.

*Record,* Factory Mutual, Norwood, MA, vol. 61, No. 1, (Spring 1984), 23 pp.

*Record,* Factory Mutual, Norwood, MA, (Summer 1984), p. 23.

*Record,* Factory Mutual, Norwood, MA, (Spring 1985), p. 17.

*Record,* Factory Mutual, Norwood, MA, (Nov.–Dec. 1988), p. 22.

*Record,* Factory Mutual, Norwood, MA, (Jan.–Feb. 1989) pp. 7–9.

*Record,* Factory Mutual, Norwood, MA, (May–Jun. 1989) pp. 9–11.

*FMRC Update,* Factory Mutual Research Corp., Norwood, MA, vol. 1, No. 1 (1987), 6 pp.

*FMRC Update,* Factory Mutual Research Corp., Norwood, MA, vol. 1, No. 2 (1987), pp. 1–4.

*FMRC Update,* Factory Mutual Research Corp., Norwood, MA, vol. 2, No. 1 (1988), pp. 1–4.

*FMRC Update,* Factory Mutual Research Corp., Norwood, MA, vol. 2, No. 2 (1988), pp. 1–4.

*FMRC Update,* Factory Mutual Research Corp., Norwood, MA, vol. 3, No. 1 (1989), pp. 1–4.

*FMRC Update,* Factory Mutual Research Corp., Norwood, MA, vol. 3, No. 2 (1989), pp. 1–4.

*FMRC Update,* Factory Mutual Research Corp., Norwood, MA, V. 4, No. 1 (1990), pp. 1–4.

*ESFR Update,* Factory Mutual Engineering Corp., Norwood, MA, vol. 1, No. 1 (1984), pp. 1–4.
*ESFR Update,* Factory Mutual Engineering Corp., Norwood, MA, vol. 1, No. 2 (1984), pp. 1–4.
*ESFR Update,* Factory Mutual Engineering Corp., Norwood, MA, vol. 1, No. 3 (1984), pp. 1–4.
*ESFR Update,* Factory Mutual Engineering Corp., Norwood, MA, vol. 2, No. 2 (1985), pp. 1–4.
*ESFR Update,* Factory Mutual Engineering Corp., Norwood, MA, vol. 2, No. 3 (1985), pp. 1–4.
Yao, C., Performance and Criteria—Automatic Sprinkler Systems; CIB Symposium on Systems Approach to Fire Safety in Buildings, Tsukuba, Japan, (Aug. 1979), 47 pp.
Thomas, S. "A Revolution in Sprinkler Technology", *Building Standards,* (May–Jun. 1984), 2 pp.
Yao, C., "The Development of the ESFR Sprinkler System", *Fire Safety Journal 14,* (1988), pp. 65–73.
*Approved Product News,* Factory Mutual Engineering Corp., Norwood, MA vol. 4, No. 2, (Dec. 1988), 10 pp.
Yao, C., "Early Suppression Fast Response Sprinkler Systems", *Chemical Engineering Progress,* (Sep. 1988), pp. 38–43.
"Warehousing New Sprinklers Put Out Fires, Save on Costs", *Modern Materials Handling,* (Dec. 1988), 1 p.
Anderson, K., "Mass. Venture a Leader in Loss Prevention", *The Journal of Commerce,* (Apr. 10, 1989), 2 pp.
"Early suppression—fast response: The Future of Fire Control", *Engineer's Digest,* (Aug. 1989), 5 pp.
Miller, C. "Early Suppression—Fast Response Sprinklers: A New Level of Industrial Fire Protection", reprint from *National Engineer,* (Sep. 1989), 2 pp.
"ESFR: Superior Warehouse Fire Protection", *Transportation & Distribution,* (Sep. 1989), 2 pp.
*ESFR Technology Facing Today's Challenges,* Factory Mutual Engineering Corp., Norwood, MA, (May 1988), 8 pp.
*Approval Standard for Early Suppression—Fast Response (ESFR) Automatic Sprinklers/Class No. 2008,* Factory Mutual Research Corp., Norwood, MA, (Aug. 1996) 53 pp. (including ERRATA addition to p. 9).
*Prevention,* Factory Mutual Engineering Corp., Norwood, MA (Aug. 1996), 36 pp.
Yao, C., "Overview of Sprinkler Technology Research", International Association for Fire Safety, Fire Safety Science Proceedings of the Fifth International Symposium, (Mar. 19, 1997), pp. 93–110.
"Preliminary Guideline ESFR Sprinklers", Factory Mutual Research Corp., Norwood, MA, (Jan. 1984), 12 pp.
Viking Technical Data "Sprinkler Installation Care and Maintenance Requirements", The Viking Corp., Hastings, MI, (Jan. 1987), 3 pp.
"Equipment Application Data, High–Challenge Sprinklers, Application Report: Digital Equipment Corporation", The Viking Corporation, Hastings, MI, (May 1986), 4 pp.
"How Digital Cuts the Risk of Storage Rack Fires", *Modern Materials Handling,* (Feb. 1986), pp. 74–76.
Scott, J. et al., "The Goal is in Sight", *Aerosol Age,* (Jun. 1987), cover and pp. 21–23.
Groos, R.T., "The Large Drop Sprinkler", *Sprinkling of News Quarterly,* (Dec. 1982), pp. 9–11.
Groos, R.T., Letter to Viking Customers, The Viking Corp., Hastings, MI (Oct. 1984), 2 pp.
Groos, R.T., "Sprinkler Protection in Rack Storage A Progress Report" The 5th Annual Convention of American Fire Sprinkler Associatrion, Anaheim, CA (Sep. 1986), 10 pp.
Groos, R.T., "Large–Drop Sprinklers: Management of High–Challenge Fires in Buildings", *Reeves Journal,* (Jan. 1986), cover and pp. 9, 10, and 12.
Groos, R.T., "Management of Fire in Buildings", *Plumbing Engineer,* (Mar.–Apr. 1985), cover and pp. 33–36.
Fleming, R., "Applications/Limitations of QRS Technology", *Sprinkler Quarterly,* (Spring 1987), pp. 15–27.
Gross, R.T., "Large–Drop sprinklers: Management of High–Challenge Fires in Buildings", ASPE 1984 Biennial Convention Technical Sessions, American Society of Plumbing Engineers, 11 pp.
Groos, R.T., "The Large Drop SPrinkler", *SPrinkler Quarterly,* (Fall 1983), pp. 38–39.
*Sprinkler Technotes,* National Fire Sprinkler Association, Patterson, NY, vol. VI, No. 4, (Jul.–Aug. 1983), 3 pp.
"Sprinklers in Storage Areas: A Comparison of Standards", *Fire,* (Jul. 1983), pp. 41–42.
Loss Prevention Data 2–7, "Installation Rules for Sprinkler Systems Using Large–Drop Sprinklers", Factory Mutual Engineering Corp., Norwood, MA (Apr. 1983), 10 pp.
Loss Prevention Data 7–29S, "Storage of Aerosol Products", Factory Mutual Engineering Corp., Norwood, MA (May 1983), 14 pp.
*Sprinkler Technotes,* National Fire Sprinkler Association, (Nov.–Dec. 1993), p. 2.
"Technically Speaking Sprinkler Technology: Research on Sensitivity", *Record,* Factory Mutual, Norwood, MA (Fall 1983), pp. 19–21.
Sherwood, S., "K Mart Learns Lessons from Warehouse Disaster", *Business Insurance,* (Oct. 31, 1983), 1 pp.
"A Large Loss for K Mart: A Lesson for Others", Factory Mutual, Norwood, MA, (1983), 8 pp.
Entwistle, N. et al., "What Happened at K–Mart's Giant Warehouse?", *Distribution,* (1983), 4 pp.
Best, R. "$100 Million Fire in K Mart Distribution Center", *Fire Journal,* (Mar. 1983), pp. 36–43.
Yao, C., et al., "Effect of Drop Size on Sprinkler Performance", National Fire Protection Association 74th Annual Meeting, Toronto, Canada, (May 1970), 29 pp.
Heskestad, G., et al., Technical Report FMRC J.I. 3A1E2.RR "Plunge Test for Determination of Sprinkler Sensitivity", Factory Mutual Research Corp., Norwood, MA, (Dec. 1980), 67 pp.
Chicarello, P.J., et al., Technical Report FMRC J.I. 0F0R2.RR "Fire Test in Roll Paper Storage Phase II", Factory Mutual Research Corp., Norwood, MA (Feb. 1981), 256 pp.
Goodfellow, D.G., et al., Technical Report FMRC J.I. 0H4R7.RR "Large–Scale Fire Tests to Study Sprinkler Sensitivity", Factory Mutual Research Corp., Norwood, MA (Mar. 1983), 191 pp.
Fleming R.P., "Quick Response Sprinklers A Technical Analysis", National Fire Protection Research Foundation, Quincy, MA (Apr. 1985), 115 pp.
Goodfellow, D.G., et al., Technical Report FMRC J.I. 0M0J5.RR "A Statistical Model for Analysis of Sprinkler Water–Spray Distributions", Factory Mutual Research Corp., Norwood, MA, (Aug. 1985), 40 pp.

Chicarello, P.J., et al. Technical Report FMRC J.I OM2R5.RR/OMOJ7.RR "Large Scale Fire Test Evaluation of Early Suppression Fast Response (ESFR) Automatic Sprinklers", Factory Mutual Research Corp., Norwood, MA, (Sep. 1985), 171 pp.
*ESFR Update,* Factory Mutual Engineering Corp., Norwood, MA, vol. 2, No. 1 (1985), pp. 1–4.
Yao, C., et al., "The ESFR Sprinkler System: A New Approach to High–Challenge Storage Protection", *Fire Journal,* (Mar. 1985), pp. 30–33, 70–72.
Beck, L., "How Digital Cuts the Risk of Storage Rack Fires", *Modern Materials Handling,* (Feb. 1986), pp. 74–76.
*Sprinkler Quarterly,* (Winter 1983–84), pp. 16–23.
Yao, C., "Early Suppression of High–Challenge Fires", *Specifying Engineer,* (1985), pp. 7–11.
Groos, R.T., "Sprinkler Developments Help Control Today's Building Fires", *Specifying Engineer,* (May 1985), pp. 78–80.
*Report,* Kemper Group, Long Grove, IL, vol. 13, No. 1 (Apr. 1984), 24 pp.
Thorne, P.F., et al., "The Thermal Performance of Sprinkler Heads", Fire Research Station, Building Research Establishment, UK (1987), 26 pp.
Carey, W., "Early Suppression Fast Response Sprinklers—A New Technology", *Building Standards,* (Jul.–Aug. 1986), pp. 6–10.
*Early Suppression—Fast Response Sprinklers* (*ESFR*), "Automatic" Sprinkler Corp. of America, Cleveland, OH (Dec. 1986), pp. 1–4.
*Early Suppression—Fast Response Sprinklers* (*ESFR*), ESFR Update—2, "Automatic" Sprinkler Corp. of America, Cleveland, OH (Feb. 1987), pp. 1–3.
*Report,* Kemper Group, Long Grove, IL, vol. 16, No. 1, (Spring 1984), pp. 1–15, 17–23.
*Report,* Kemper Group, Long Grove, IL, vol. 16, No. 3, (Dec. 1987), pp. 1–16.
Viking Technical Data "High Challenge® Model 'A' Upright", The Viking Corp., Hastings, MI, (Feb. 1983), 1 p.
Viking T
"Equipment Application Data High Challenge® Sprinklers", The Viking Corp., Hastings, MI (1984), 4 pp.
File Ex643 "Report on Automatic Sprinklers", Underwriters Laboratories, Inc., (May 1981), 18 pp.
*The Q.R.S. "Link",* National Fire Protections Research Foundation, Quincy, MA, (Jan.–Feb. 1986), 4 pp.
"Heat–Sensing Sprinkler Snuffs Fires Faster", *Design News,* (Dec. 18, 1989), pp. 88–89.
Campbell, L.E., Letter to Factory Mutual Research Corp., The Reliable Automatic Sprinkler Co., Inc., Mount Vernon, NY, (Dec. 3, 1974).
Miller, C.E., Letter to the Reliable Automatic Sprinkler Co., Inc., A Factory Mutual Systems, Norwood, MA, (Dec. 17, 1974) 1 pp.
"Ultra™ K–25 ESFR Low Pressure Early Suppression Fast Response", Central Sprinkler, (Oct. 1997), 4 pp.
Directional Spray Nozzles, Open Type D3 Large Capacity Protectospray®–1 NPT, Grinnell Corporation, Exeter, NH, (Nov. 1992) 4 pp.
Sheet entitled "Grinnel Protectospray Nozzle Type D3 (Large Capacity)", Grinnell Corporation, (Apr. 1964), 1 p.
Drawing entitled "Grinnell Large Capacity Protectospray Nozzle Type D–3 Frame", "B–1800", Grinnell Corporation, (Jun. 1981), 1 p.
Drawing entitled "Grinnell Large Capacity Protectospray Nozzle Type D–3 Assembly", "B–1801", Grinnell Corporation, (Jun. 1981), 1 p.
Drawing entitled "Grinnell Protectospray Nozzle Type D–3, D–4 Splitter" and "A–7023", Grinnell Corporation, (Dec. 1966), 1 p.
Drawing Entitled "Grinnell Protectospray Nozzle Type D–3, Deflector", Grinnell and "A–3780", Grinnell Corporation, (Jan. 1974), 1 p.
Collection of figures, Figure 1–Figure 7 entitled "Types D–3 and D–4a Protectospray Nozzles", Figure 8—Figure 9 entitled "Type D3 Large Capacity Protectospray Nozzles" and Figure 10—Figure 13 entitled "Type EA–1 Protectospray Nozzles", Grinnell Corporation, (Sep. 1985), 13 pp.
Underwriters Laboratories, Inc., UL 1767, "Standard For Safety, Early–Suppression Fast–Response Sprinklers", First Edition, (Feb. 1990).
Factory Mutual Engineering Corp., "Loss Prevention Data, 2–2", "Early Suppression Fast Response Sprinklers", (Apr. 1987).
Factory Mutual Research, "Approval Standard, Early Suppression Fast Response Automatic Sprinklers", (Jun. 1986).
"Automatic" Sprinkler Corporation of America product sheets entitled "Automatic ESFR Glass Bulb Sprinkler", (Feb. 1998), pp. J 5.3, J 5.4.
ASCOA Fire Systems data sheets entitled "Automatic ESFR Glass Bulb Sprinkler", (Mar. 1992), pp. 1.1, 1.2.
Grinnell Corporation data sheets entitled "Early Suppression Fast Response Sprinklers/Model ESFR–1 Pendent, 14.3 K–Factor", (Apr. 1988).
Reliable Automatic Sprinkler product announcement, "ESFR, Model H Early Suppression Fast Response Sprinkler", (Oct. 1992), 3 pp. total.
Central Sprinkler Company catalog sheets entitled, "Central ESFR–1 3–93/ESFR Early Suppression Fast Response", (Mar. 1993), 4 pp.
Drawing entitled "International Jumbo Sprinkler Head–Deflector", DWG. No. 1–117, Automatic Sprinkler Co. of America, (Mar. 1926), 1 p.
Sheet entitled "Grinnell Jumbo Sprinkler Issue A", Grinnell Corporation, (Feb. 1969), 1 p.
Drawing entitled "Solder Type—Issue "A" 1 ¼" Grinnell Jumbo Sprinkler York, Body, Strut, Diaphragm and Disc, General Fire Extinguisher Company, (Apr. 1917), 1 p.
Drawing entitled "1" Grinnell Jumbo Sprinkler Detail Solder Type Issue 'A', General Fire Extinguisher Co., (Apr. 1917), 1 p.
Thompson, N.J., *Fire Behavior And Sprinklers,* Chapter 6 "Automatic Sprinkler Protection", National Fire Protection Association, (1964), Cover, Foreward, Table of Contents and pp. 72–91.
Newsletter for Fire Protection Engineers and Industry, Orinda, California, No. 11, (Jul. 1965), 8 pp.
Goodfellow, D.G., et al. *Technical Report* entitled "Optimization Of Sprinkler Protection For United States Postal Service III Protection Of Plastic Letter Trays", Factory Mutual Research Corporation, (Oct. 1971), 39 pp.
Goodfellow, D.G., *Technical Report* entitled "Optimization Of Sprinkler Protection For United States Postal Facilities IV Protection Of Plastic Letter Trays with 0.64–inch Retrofit Sprinklers", Factory Mutual Research Corporation, (Jul. 1974), 30 pp. with cover and introductory pages.

E.W.J. Troup, *Technical Report* entitled "New Developments in Ceiling–Level Protection for the High–Challenge Fire", Factory Mutual Research Corporation, (Jan. 1974).
Chicarello P.J., et al. *Technical Report* entitled "Large–Scale Fire Test Evaluation Of Early Suppression Fast Response (ESFR) Automatic Sprinklers", Factory Mutual Research Corporation, (May 1986), cover–p. 18 and pp. 122–128.
Yao, C., "The Development of the ESFR Sprinkler System", *Fire Safety Journal,* Elsevier Scientific Ltd. Kidlington, Oxford, U.K., vol. 14, No. 1, (1988), pp. 65–73.
Yao, C., "Overview Of FMRC'S Sprinkler Technology Research", Factory Mutual Research Corp., (May 1992).
*Approved Product News,* Factory Mutual Engineering Corp., vol. 4, No. 2, (Dec. 1988), pp. 1–5, 8–12 and 16.
*Fire Protection Handbook,* Seventeenth Edition, National Fire Protection Association, (1991), Title page, inner page, Table of Contents p. IX and pp. 5–127 through 5–163 and 5–174 through 5–197.
Bell, K., "Presentation To American Fire Sprinkler Association—Large K–Factor Sprinklers", (Nov. 1992), 59 pp. total: 19 pp. text and 40 pp. slide photocopies.

Color photocopies of six color photographs of sprinkler cast with "I.S. Co." on deflector and "PAT.03" on the body and "1903" stamped on the release link, (labeled Jun. 1995), 2 pp.

Color photocopies of six color photographs of sprinkler cast with "Globe" and "280" on body, "G A S Co." on deflector and stamped "1926" on release link, (labeled Jun. 1995), 2 pp.

Color photocopies of five color photographs of Grinnell Corporation "Jumbo A" automatic sprinkler—1¼orifice, (labeled Jun. 1995), 2 pp.

Color photocopies of five color photographs of Grinnell Corporation "Jumbo A" automatic sprinkler—1 orifice, (labeled Jun. 1995), 2 pp., (body painted red).

* cited by examiner

LOW PRESSURE, EARLY SUPPRESSION FAST RESPONSE SPRINKLERS

"This is a continuation application of copending application Ser. No. 09/183,990 filed on 2 Nov. 1998 now U.S. Pat. No. 6,502,643, which is a continuation application of application Ser. No. 08/813,780 filed 7 Mar. 1997 (now U.S. Pat. No. 5,829,532, issued 3 Nov. 1998), both of which are herein incorporated by reference in their entirety."

BACKGROUND OF THE INVENTION

Early suppression fast response ("ESFR") sprinklers are a well known and well defined class of ceiling fire sprinklers. ESFR sprinklers were developed in the 1980's by Factory Mutual Research Corporation ("FM") with the assistance of certain sprinkler manufacturers in an effort to provide improved fire protection against certain high-challenge fire hazards. According to FM, ESFR sprinklers combine fast response with greater supplied and actually delivered water densities for greater fire suppression capability. Previous sprinklers (standard sprinklers) provided protection by merely keeping such fires under control. Ultimately, the initial fuel source would deplete itself or other fire fighting equipment would have to be brought to the scene to extinguish the fire.

The performance requirements of ESFR sprinklers are set forth in Underwriters Laboratories, Inc. ("UL") STANDARD FOR EARLY-SUPPRESSION FAST-RESPONSE SPRINKLERS UL 1767. This standard was first published in 1990. Factory Mutual Research Corporation ("Factory Mutual" or "FM") also has an Approval Standard For Early Suppression—Fast Response (ESFR) Automatic Sprinklers, Class Number 2008. The current ESFR standards and all earlier ESFR standards of either organization are incorporated by reference herein in their entirety.

Requirements for the installation and use of ESFR sprinklers are included in various standards of the National Fire Protection Association including the Standard for the Installation of Sprinkler Systems, NFPA 13; the Standard for General Storage, NFPA 231; and the Standard for Rack Storage of Materials, NFPA 231c. The current and earlier editions of these standards to the extent that they pertain to ESFR sprinklers are incorporated by reference herein. Installation and use requirements for ESFR sprinklers are also given Loss Prevention Data sheets 2-2, "EARLY SUPPRESSION FAST RESPONSE SPRINKLERS", *Factory Mutual System*, Factory Mutual Engineering Corp., 1987, which is also incorporated by reference herein. Loss Prevention Data sheets 2-8 N, "Installation of Sprinkler Systems", *Factory Mutual System*, Factory Mutual Engineering Corp., 1989, presents other installation and use requirements for ESFR and other sprinklers generally which are not presented in Loss Prevention Data sheets 2-2 and is also incorporated herein.

The standards specify the construction, performance, installation and operation of ESFR sprinklers with significant particularity. For example, the discharge coefficient (or "K" factor) of an ESFR sprinkler is nominally 14 and must be within the range of 13.5–14.5, where the discharge coefficient is calculated by dividing the flow of water in gallons per minute through the sprinkler by the square root of the pressure of water supplied to the sprinkler in pounds per square inch gauge. Ordinary or standard sprinklers are considered to have response time indices ("RTI") of 100 meter$^{1/2}$ second$^{1/2}$ ("m$^{1/2}$ sec$^{1/2}$") or more although the response time indices actually reported for these sprinklers have all exceeded 100 m$^{1/2}$ sec$^{1/2}$. One special class of faster operating sprinklers exists with response time indices between 50 and 80 m$^{1/2}$ sec$^{1/2}$. Existing ESFR sprinklers must exhibit response time indices of less than 40 m$^{1/2}$ sec$^{1/2}$. The installation and use standards further require, among other things, that a minimum operating pressure of 50 psi be provided to ESFR sprinklers.

ESFR sprinklers were originally designed to suppress fires in warehouses with thirty-foot ceilings where flammable stock such as certain plastics is piled up to twenty-five feet high in racks. In many instances, available water supplies are not capable of providing a minimum operating pressure of 50 psi to thirty-foot high sprinklers. In such cases, a supplemental pump is needed to boost water pressure before ESFR sprinklers can be used. The cost of providing an auxiliary pump can be significant. For example, in protecting a 40,000 square foot building with ESFR sprinklers, it is estimated that the cost of providing an auxiliary pump can represent about twenty-five (25) percent of the entire cost of the installed sprinkler system. In certain installations, a second, back-up pump may be needed. If comparable protection might be provided at pressures below the current 50 psig minimum required pressured for ESFR sprinklers, the need for a pump might be avoided. In instances where a pump would be required in any event, lower pressure requirements may permit the use of a lower capacity, less expensive pump or the use of the same pump with smaller diameter, higher friction but less expensive supply lines. Each of these three possible options could provide significant savings in installation costs of ESFR sprinklers.

BRIEF SUMMARY OF THE INVENTION

In one aspect the invention is a low pressure, early suppression fast response sprinkler comprising a generally tubular body having an inlet end, an opposing discharge end and an internal passageway extending between the inlet and discharge ends with a K factor greater than 16 where the K factor equals the flow of water in gallons per minute through the internal passageway divided by the square root of the pressure of water fed into the internal passageway in pounds per square inch gauge; a deflector coupled with the tubular body and spaced from and generally aligned with the discharge end of the internal passageway so as to be impacted by a flow of water issuing from the discharge end of the passageway upon activation of the sprinkler, the deflector being configured and positioned to deflect the flow of water generally radially outwardly all around the sprinkler, a closure releasably positioned at the discharge end of the tubular body so as to close the internal passageway; and a heat responsive trigger mounted to releasably retain the closure at the discharge end of the tubular body, the trigger having a response time indices of less than 100 meters$^{1/2}$ sec$^{1/2}$ (m$^{1/2}$ sec$^{1/2}$).

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred It should be understood, however, that the invention is not limited to the precise arrangements and instrumentalities shown. In the drawings which are diagrammatic.

DETAILED DESCRIPTION OF THE INVENTION

Figure 1:
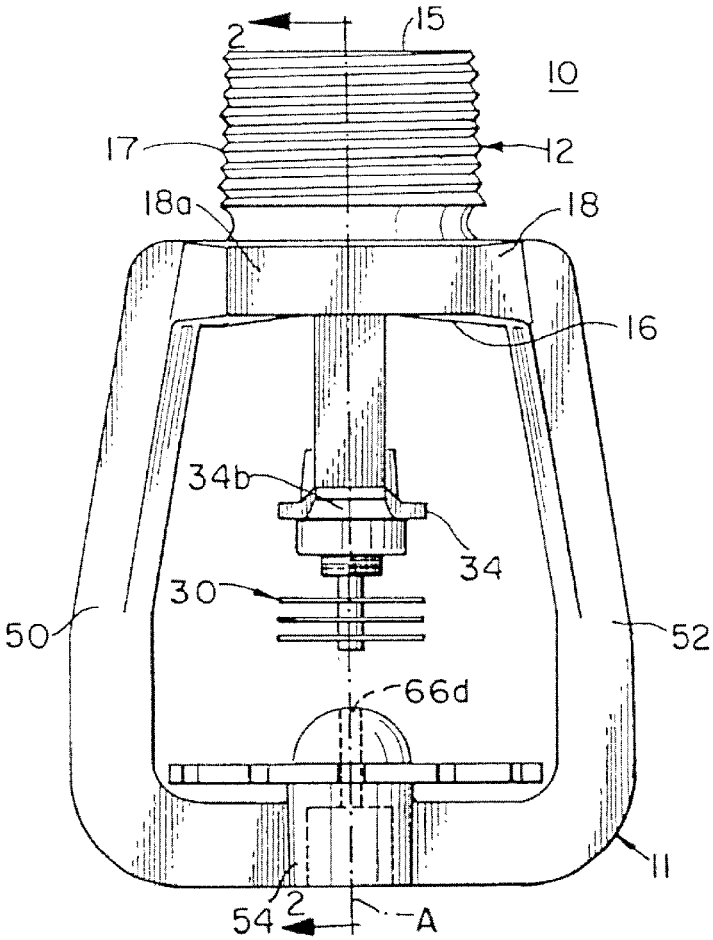
FIG. 1 is an elevation view of an low pressure, early suppression fast response ceiling sprinkler of the present invention.

In the drawings, like numerals are used to indicate like elements throughout. There is shown in various views in FIGS. 1, 2 and 5, a low pressure, early suppression fast response fire sprinkler of the present invention indicated generally at 10. Sprinkler 10 includes a preferably one-piece frame 11 having an at least generally tubular body indicated generally at 12 with a preferably tapered, central, internal passageway 14. The passageway 14 preferably extends straight between an inlet end 15 and a discharge end 16 of the tubular body 12. Threads 17 are provided on the outside of the inlet end 15 to permit the sprinkler 10 to be coupled to a drop or supply pipe (neither depicted) for delivery of water or another fire fighting fluid. The internal passageway 14 of body 12 has a preferably straight central axis A indicated in FIGS. 1 and 2.

Sprinkler 10 further includes a closure 20 releasably positioned at the discharge end 16 of the tubular body 12 so as to close the internal passageway 14, a heat responsive trigger indicated generally at 30 mounted to releasably retain the closure 20 at the discharge end 16 of the tubular body 12 closing the passageway 14 until the trigger 30 is activated, and a deflector indicated generally at 60.

Referring to FIG. 1, the frame 11 further includes a pair of support arms 50, 52 which extend generally away from opposite sides of the discharge end 16 of the tubular body 12 and meet to form a tubular knuckle 54 located along central axis A. The arms 50, 52 and knuckle 54 support the deflector 60 positioned juxtaposed to, facing and speed away from the discharge end 16 of the tubular body 12. While at least two symmetrically positioned support arms 50, 52 are preferred, three or four support arms might be provided, preferably all symmetrically positioned around and spaced away from the central axis A. Where more than two support arms are provided, they may be separately attached to a tubular body, for example, by being threaded into a flange portion of such separate tubular body.

The frame 11 is preferably enlarged at the discharge end 16 of the tubular body 12 into a circumferential flange 18. The flange 18 is preferably hexagonally shaped with a pair of major opposing parallel flat surfaces or "flats" 18*a* positioned to receive an open ended wrench or a specially designed hexagonal sprinkler wrench for threading the sprinkler 10 into a drop or other fluid supply line (neither depicted).

Figure 2:
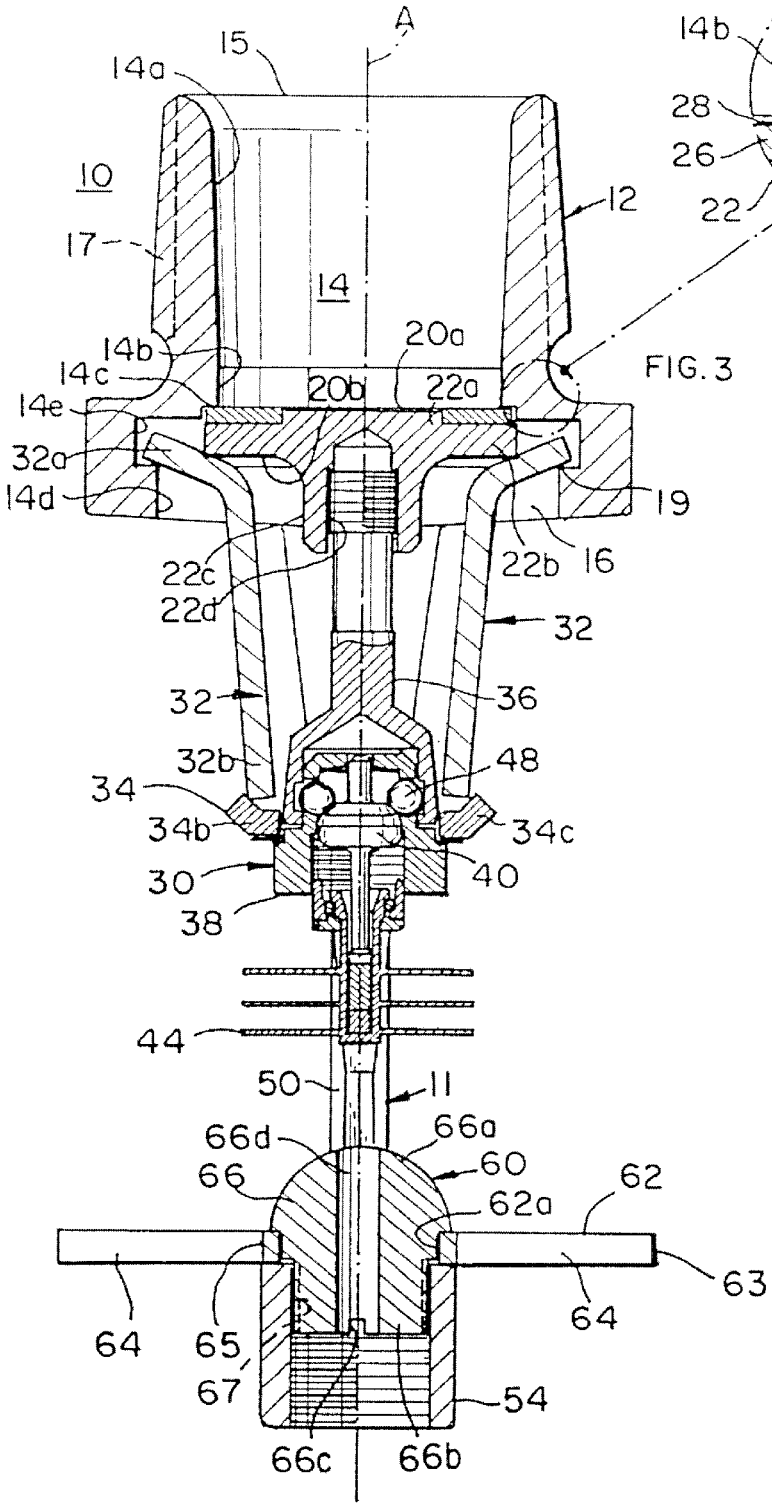
FIG. 2 is a partial cross-sectional view of the sprinkler taken generally along the lines of 2—2 in FIG. 1.

Referring to FIG. 2, the internal passageway 14 includes an inwardly tapering portion 14*a* extending from the inlet end 16 to a cylindrical portion 14*b* of uniform, reduced diameter. A portion 14*c* of the passageway immediately downstream from the reduced diameter portion 14*b* is provided with a greater diameter to receive the closure 20 over the reduced diameter portion 14*b*. Portion 14*c* may be outwardly beveled at approximately a 10°–15° angle for its length to foster release of the closure 20 (see FIG. 3). The passageway 14 then abruptly and significantly enlarges in diameter into a cylindrical outlet opening 14*d* at the discharge end 16 of the frame body 12. A lip 19 is formed around the outlet opening 14*d* by the provision of a circular groove 14*e* between the lip 19 and the beveled end of portion 14*c* of the passageway.

The tubular body 12 may have an axial length of about one and one-third inches with the flange 18 having a length of about one-third inch. The inwardly tapering portion 14*a* may have a length of about seven-eighths of an inch and taper down at about a one and one-half degree angle to central axis A from a width of 0.98 to a width of 0.93 inches, which is continued for about one-eighth of an inch in reduced diameter portion 14*b*. Portion 14*c* may have a minimum diameter of about one inch and a length of about one-sixteenth inch. In the preferred embodiment, the outlet opening 14*d* may have a diameter of about one and one-third inches and an axial length of about one-third inch while the groove 14*e* has a diameter of about one and one-half inches and an axial length of only about one-eighth inch.

The preferred sprinkler 10 has a nominal discharge coefficient or K factor of 25. The discharge coefficient or K factor equals the flow of water through the internal passageway 14 in gallons per minute divided by the square root of the pressure of water fed into the tubular body in pounds per square inch gauge. The discharge coefficient is governed in a large degree by the smallest cross sectional area of the passageway 14, in other words, the diameter of the cylindrical portion 14*b* of passageway 14. The discharge coefficient or "K" factor of a sprinkler is determined by standard flow testing. For ESFR sprinklers, ay 14 is measured first at a pressure of 15 ig, and then in 5 psig increments up to 50 psig and then in 10 psig increments up to 100 psig, and then in 25 psig increments at 125, 150 and 175 psig. The flow is decreased in the same increments back to the original 15 psig value. The flow is measured at each increment of pressure by a flow-measuring device having an accuracy within about 2 percent of the actual flow. The actual flow in gallons per minute is divided by the square root of the pressure of the supplied water in psig at each increment. An average value is then calculated from all of the incremental values and becomes the flow coefficient or "K" factor of the sprinkler.

Discharge coefficients of K factors can be "nominal" values. Typically "nominal" K factors are expressed in standard sizes, which are integer or half integer values. These standard or "nominal" values encompass the stated integer or half integer value plus or minus one-half integer. Thus, a nominal K factor of 25 encompasses all measured K factors between 24.5 and 25.5.

Figure 3:
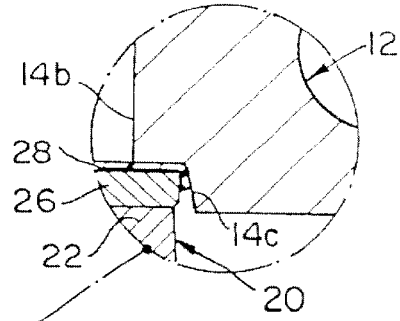
FIG. 3 is a greatly enlarged view of the encircled area 3 of FIG. 2.

Referring to FIG. 2, the closure 20 preferably is also a subassembly and has an upstream end 20*a*, which is received over the reduced diameter portion 14*b* of the passageway 14 in the beveled portion 14*c* of the passageway. A downstream end 20*b* of the closure 20 engages a proximal end of the trigger 30. Referring to FIG. 3, the closure 20 is formed by a saddle 22 and a washer subassembly that includes a Belleville washer 26 bearing a sheet of plastic film tape 28, preferably a triflouroethylene tape on one side, which is the side of the closure 20 facing the uniform reduced diameter portion 14*b* of the passageway 14. Saddle 22 is a generally rotationally symmetric body including a cylindrical plug portion 22*a*, which is received within a center opening of the Belleville washer 26 to stabilize the washer with respect to the saddle 22. The saddle has a circular flange portion 22*b* with an outer diameter approximately equal to the outer diameter of the Belleville washer 26 and slightly greater than the diameter of reduced diameter portion 14*b*. Saddle 22 further includes a central circular boss 22*c* projecting away from the plug portion 22*a* with a threaded central bore 22*d*.

The preferred trigger 30 is an assembly which preferably includes a pair of identical, generally L-shaped levers 32. Each lever 32 includes a short arm portion 32*a*, which is positioned between lip 19 and the downstream end 20*b* of the closure 20, releasably retaining the closure 20 in the internal passageway 14 closing the passageway. Long arm portions 32*b* of the levers 32 extend away from discharge end 16 of the tubular body 12 and passageway 14 and are held together by a lever yoke 34. Yoke 34 preferably is a one-piece, generally octagonally-shaped body with a central circular opening. Diametrically opposed portions 34*b* and 34*c* of the body are bent around the proximal long ends 32*b* of the levers 32, thereby holding those ends together and releasably retaining the closure 20 in the passageway 14 so as to close the passageway 14. Cutouts can be provided on the outer edges of the flange portion 22*b* of the saddle to receive and stabilize the position of the short arm portions 32*a* of the levers 32.

Figure 4:
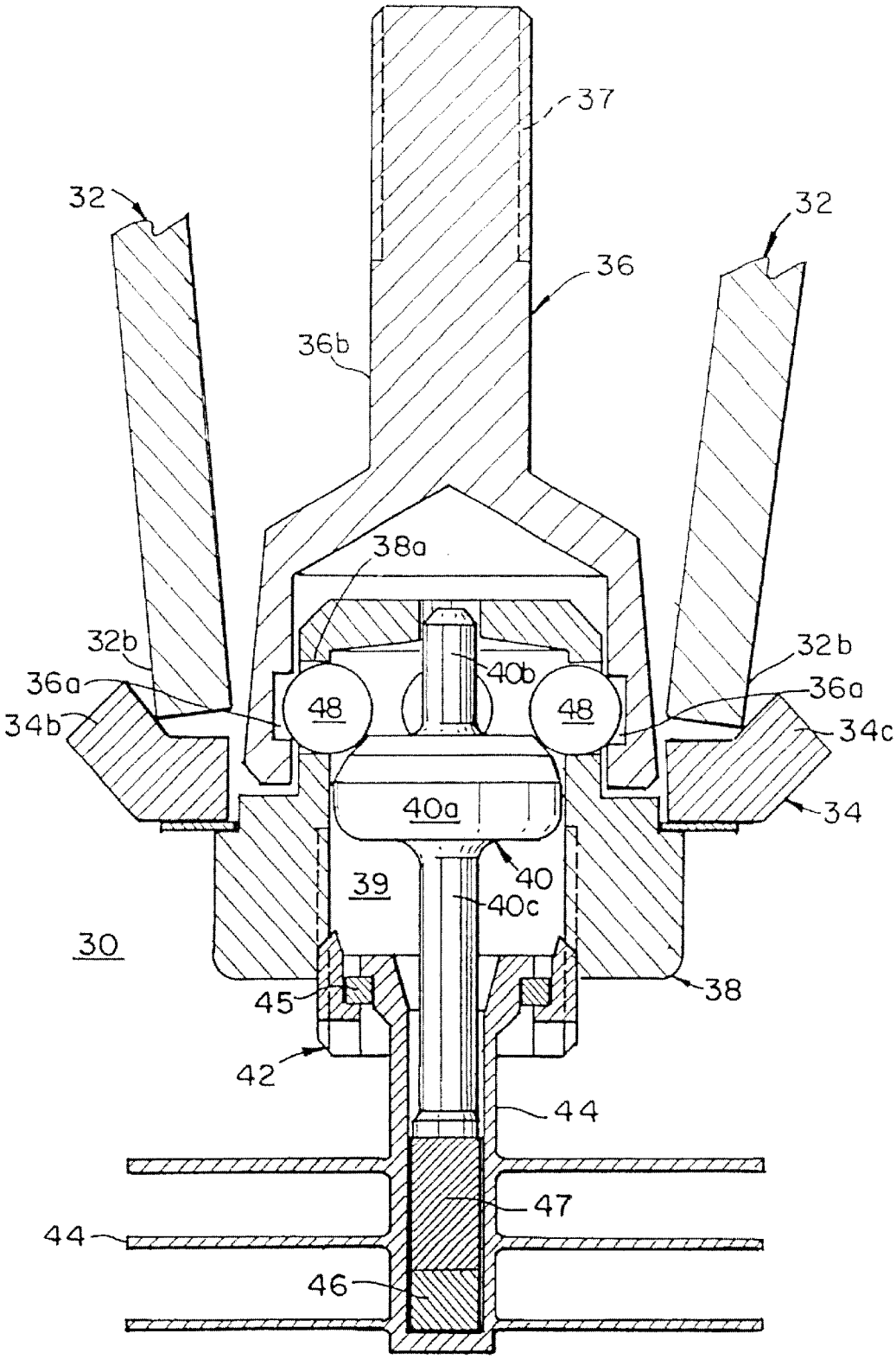
FIG. 4 is a sectional elevation of the trigger.

Referring to FIGS. 2 and 4, trigger 30 further includes a retainer body 36, a plunger housing 38 having one end received in the retainer body 36 and a retaining nut received in a remaining end of the plunger housing 38 and forming a plunger chamber 39 receiving a plunger 40. Those and other elements of trigger 30 are best seen in FIG. 4. A retaining nut 43 supports a finned heat collector 44 from a side of the plunger housing 38 opposite the retainer body 36. The finned heat collector 44 is preferably coupled with and thermally insulated from the retaining nut 43 by a thermally insulative support washer 45 of a suitable material such as glass reinforced nylon. The finned heat collector 44 is hollow and contains a pellet 46 of a metal alloy having a melting temperature at the desired operating or response temperature of the sprinkler 10. Plunger 40 is formed by a pin and a generally bulbous main body 40*a* along the pin, which divides the pin into upper and lower ends 40*b* and 40*c*. The lower pin end 40*c* of plunger 40 is supported on the metal alloy pellet 46 by a cylindrical bearing disk 47 made of a material such as alumina having significant compressive strength and thermal insulative properties. The upper pin end 40*b* guides and centers the plunger 40 in the chamber 39. The purpose of the pellet 46, bearing disk 47 and plunger 40 is to support a plurality of balls 48 which extend through bores 38*a* in the side walls of the plunger housing 38 and into aligned recesses 36*a* in the retainer body 36 thereby releasably locking the retainer body 36 and plunger housing 38 together. The "free" or "upper end" 36*b* of the retainer body 36 bears external threads 37 (diagrammatically by phantom), which are received in the threaded central bore 22*d* of the saddle 22 of the closure 20. Levers 32, which are held together by lever yoke 34, releasably retain closure 20 in the tubular body 12. The retainer body 36 is held through saddle 22 and the remainder of the trigger 30 is coupled with the saddle through the retainer body 36 by means of the balls 48. The balls 48, in turn, are held by the bulbous main body 40*a* of the plunger 40, which is forced against the balls 48 by tightening of the retaining nut 43 into the plunger housing 38. The alloy pellet 46 will lose its load bearing strength when heated sufficiently allowing the balls to move and permitting the plunger housing 38 and lever yoke 34 to separate from the retainer body 36 and levers 32, respectively, releasing closure 20 with trigger 30 permitting water (or other fire fighting fluid) to pass rough the internal passageway 14 and from the discharge end 16 of the passageway 14 and body 12.

Figure 5:
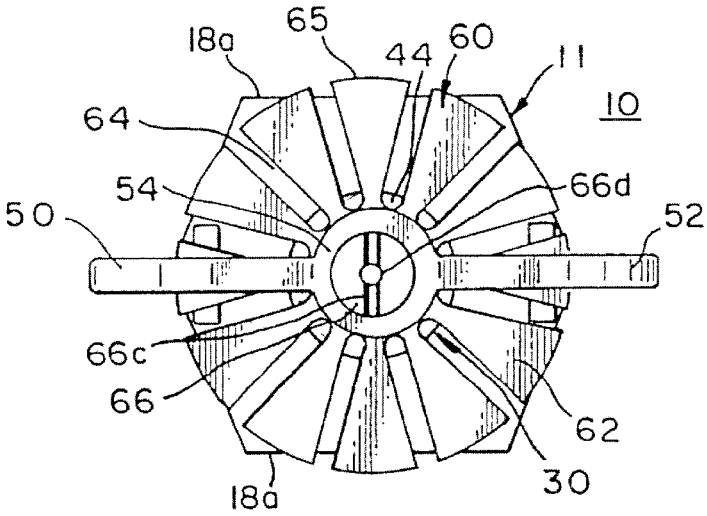
FIG. 5 is a bottom view of the sprinkler of FIG. 1.

The structure and mounting of the deflector 60 are best seen in FIGS. 1, 2 and 5. Deflector 60 includes a plate 62, and a nose piece positioned in an opening in the center of the plate 42.

The plate 62 of the deflector is planar and circular with a circular outer perimeter 63 and a plurality of slots 64 extending radially inwardly from the circular perimeter 63 and axially entirely through the plate 62. The plurality of slots 64 surround and define a "slotless" central area 65 as best seen in FIG. 2. As used herein "slotless central area" refers to a circular central area at the center of the deflector, which has a radius equal to the radius of the plate member less the radial length of the longest slot extending radially from the outer perimeter of the plate member in a planar projection of the deflector prependicular to central axis A. Thus, if the nose piece of the deflector overlaps the innermost ends of some or all of the slots, the slotless central area is the planar area of the nose piece which covers the ends of such slots. In the preferred embodiment, the outer diameter of the central area 65 is substantially equivalent to the outer diameter of the frame knuckle 54.

The nose piece 66 has a head portion 66*a* facing the tubular body 14 which is suggestedly rounded in shape and preferably hemispheric. The head portion 66*a* supports a shaft portion 66*b* bearing external threads 67 (indicated diagrammatically by phantom lines) which permit the nose piece 66 to be screwed into the internally threaded knuckle 54. A slot 66*c* may be provided at the base of the shaft portion 66*b* to receive a screw driver. The nose piece passes through a circular opening 62*a* provided in the center of the deflector plate 62 (within the central area 65) and holds the plate 62 firmly to the knuckle 54. The deflector 60 is coupled with the tubular body 14 through knuckle 54 and is positioned juxtaposed to and spaced from the discharge end 16 of the tubular body 12 aligned with the discharge end 16 of the internal passageway central axis A of the tubular body. Nose piece 66 is further preferably provided with a central bore 66*d* also aligned with the central axis A of the internal passageway 14 and discharge end 16 of the tubular body 12. The deflector 60 is configured by being generally rotationally symmetric and positioned by being centered on central axis A to deflect the flow of water issuing from the discharge end of internal passageway 14 generally symmetrically radially outwardly all around the sprinkler 10. Bore 66*d* permits water to pass axially entirely through the center of the deflector 60 and down directly under the sprinkler 10. This bore 66*d* combined with the much larger orifice size of internal passageway 14 in comparison to the diameter of the slotless central area of the deflector has proven sufficient to deliver adequate water densities directly beneath the sprinkler 10 to suppress high challenge fires originating directly under sprinkler 10 as well as to such fires originating between such sprinklers 10.

Sprinklers 10 of the present invention are installed in accordance with standard ESFR limitations including spacing and height limitations.

For the preferred 25 K factor tubular body having a minimum diameter of 0.930 inches in the reduced diameter cylindrical portion 14*b* of the internal passageway 14, the head portion 66*a* of the nose piece 66 is provided with a radius of about one-quarter inch and with a bore 66*d* having a diameter of about one-eighth inch. The deflector plate 62 is preferably 1.9 inches in outer diameter and about one-tenth of an inch thick. Plate 62 is provided with twelve slots 64 uniformly angularly arrayed in 30° increments around central axis A. Each slot 64 is about one-tenth inch in width and terminates in a radius (semicircle). The diameter of the central area surrounded by and located within the slots 64 is suggestedly about five-eighths inch.

The surface of the knuckle 54 closest to the tubular body 14 is spaced about two and one-half inches from the proximal end of the reduced diameter cylindrical portion 14*b* of the internal passageway 14. The ratio of the outer diameter of the deflector 60, more particularly the deflector plate 62, to the radial length of the slots 64 is about 3 (1.9/0.635). The plurality of slots 64 provide a total open area of less than one-third but more than one-quarter the total planar area within the circular perimeter 63 of the deflector. All of these values are within the ranges exhibited by existing ESFR sprinklers. However, the ratio of the minimum passageway diameter of the tubular body to the diameter of the central area of the deflector is about 1.5 (0.93 in/0.624 in). The highest ratio previously exhibited in an ESFR sprinkler was less than 1.3.

One of the requirements for an ESFR sprinkler is fast response. Response can be measured in various ways. Factory Mutual and Underwriters Laboratories, use a combination of temperature ratings and response time indices to insure adequately fast response is being provided.

The response time indices or "RTI" is a measure of thermal sensitivity and is related to the thermal inertia of a heat responsive element of a sprinkler RTI is insensitive to temperature. For fast-growing industrial fires of the type to be protected by ESFR sprinklers, it is believed that the RTI and temperature rating of the trigger are sufficient to insure adequately fast sprinkler response. The temperature rating is the range of operating temperatures at which the heat responsive element of a sprinkler will activate.

RTI is equal to $\tau u^{1/2}$ where $\tau$ is the thermal time constant of the trigger in units of seconds and u is the velocity of the gas across the trigger. RTI is determined experimentally in a wind tunnel by the following equation:

$$RTI = -t_x u^{\frac{1}{2}} \Big/ \ln(1 - \Delta T_b / \Delta T_g)$$

where $t_x$ is the actual measured response or actuation time of the sprinkler; u is the gas velocity in the test section with the sprinkler; $\Delta T_b$ is the difference between the actuation temperature of the trigger (determined by a separate heat soak test) and the ambient temperature outside the tunnel (i.e. the initial temperature of the sprinkler); and $\Delta T_b$ is the difference between the gas temperature within the tunnel where the sprinkler is located and the ambient temperature outside the tunnel. The RTI for ESFR sprinkler is determined with air heated to 197 (±2)° C. and passed at a constant velocity of 2.56 (±0.03) m/sec over the sprinkler 10 and trigger 30 inserted into the air stream in the pendent position (see FIG. 1) with a plane through frame arms 50, 52 being perpendicular to the direction of the heated air. The aforesaid FM and UL Standards should be consulted for further information if desired.

When fast response was being investigated in the 1980's, the RTI's so-called standard sprinklers were measured and were found to be more than 100 $m^{1/2}$ $sec^{1/2}$ typically up to nearly 400 $m^{1/2}$ $sec^{1/2}$. RTI's of less than 100 $m^{1/2}$ $sec^{1/2}$ are considered faster than standard sprinkler responses. A class of "special" sprinklers has been recognized having RTI's between 80 and 50 $m^{1/2}$ $sec^{1/2}$. RTI values currently acceptable for ESFR sprinklers are less than 40 $m^{1/2}$ $sec^{1/2}$, more particularly 19 to 36 $m^{1/2}$ $sec^{1/2}$. Applicants' sprinkler is the first known sprinkler to combine any K factor of more than 16 with any trigger (thermally responsive element) having an RTI of less than 100 or even 80 or less $m^{1/2}$ $sec^{1/2}$ for any use and also the first having such combined parameters to successfully suppress a high challenge fire as demonstrated by standard laboratory tests.

The 25 K factor sprinkler 10 will supply 100 gallons per minute at a flow pressure of less than 16 psig while one with a K factor of 26 will supply 100 gallons per minute at just under 15 psi. Applicants believe that 15 psi is the minimum pressure needed to drive drops of the size generated by the sprinkler 10 into the heated plume created by a high challenged fire. The nominal 25 K sprinkler of the present invention therefore is believed to be optimally-sized for its use. However, ESFR sprinklers providing 100 gallon per minute flows at pressures of more than 15 but less than 50 psi can also be commercially valuable. To supply 100 g.p.m. of water at 40 psi requires a K factor of about 16 (15.8). To supply the same amount of water at 30 psig requires a K factor of about 18.5 (18.3) while to supply the same amount of water at 20 psig requires a K factor of about 22.5 (22.4). The reduced diameter portion 14*b* of the internal passageway might have a diameter greater than 0.76 inches to yield a K-factor greater than 16, a diameter of about 0.85 inches to yield a nominal K-factor of about 20, a diameter of about 1.0 inch to yield a K-factor of about 30 and a diamter of about 1.2 inches to yield a K-factor of about 40.

Furthermore, investigations are underway with respect to the suppression of fires even more challenging than those addressed by the original ESFR sprinkler standards. These higher challenges include storage in warehouses piled up to forty feet under forty-five foot ceilings and up to forty-five feet under fifty-foot ceilings. Applicants believe that water might similarly be supplied in even greater quantities at flow pressures of at least 15 psig to successfully suppress such fires. For example, a flow rate of 120 gallons per minute can be supplied at a pressure of 15 psig (or less) by a K factor of about 31, 140 gallons per minute by a K factor of about 36, and 150 gallons per minute by a K factor of less than 40 (38.7). At pressures of 20 psig, 120 gallons per minute can be supplied by a K-factor of about 27 (26.8), 140 gallons per minute can be supplied by a K-factor of about 31.5 (31.3) and 150 gallons per minute can be supplied by a K-factor of about 33.5.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A low pressure, early suppression fast response sprinkler for suppression of a high-challenge fire created by a high-challenge fire hazard, the sprinkler comprising:

a generally tubular body having an inlet end, an opposing discharge end and an internal passageway extending between the inlet and discharge ends with a K factor greater than 16 where the K factor equals the flow of water in gallons per minute through the internal passageway divided by the square root of the pressure of water fed into the tubular body in pounds per square inch gauge;

at least one support arm disposed on the tubular body;

a deflector coupled with the tubular body via the at least one support arm and spaced from and generally aligned with the discharge end of the internal passageway so as to be impacted by a flow of water issuing from the discharge end of the passageway upon activation of the sprinkler by the high-challenge fire, the deflector being configured and positioned to deflect the flow of water generally radially outwardly all around the sprinkler to provide suppression of the high-challenge fire created by the high-challenge fire hazard;

a closure releasably positioned at the discharge end of the tubular body so as to close the internal passageway; and a heat responsive trigger mounted to releasably retain the closure at the discharge end of the tubular body, the trigger having a response time index of less than 100 meter$^{1/2}$ sec$^{1/2}$ (m$^{1/2}$ sec$^{1/2}$).

2. The sprinkler of claim 1, wherein the K factor is between 18 and 40.

3. The sprinkler of claim 2, wherein the K factor is greater than 20.

4. The sprinkler of claim 3, wherein the K factor is between 22 and 26.

5. The sprinkler of claim 4, wherein the response time index is less than 80.0 m$^{1/2}$ sec$^{1/2}$.

6. The sprinkler of claim 5, wherein the response time index is less than 40 m$^{1/2}$ sec$^{1/2}$.

7. The sprinkler of claim 3, wherein the response time index is less than 80.0 m$^{1/2}$ sec$^{1/2}$.

8. The sprinkler of claim 7, wherein the response time index is less than 40 m$^{1/2}$ sec$^{1/2}$.

9. The sprinkler of claim 2, wherein the response time index is less than 80.0 m$^{1/2}$ sec$^{1/2}$.

10. The sprinkler of claim 9, wherein the response time index is less than 40 m$^{1/2}$ sec$^{1/2}$.

11. The sprinkler of claim 1, wherein the response time index is less than 80.0 m$^{1/2}$ sec$^{1/2}$.

12. The sprinkler of claim 11, wherein the response time index is less than 40 m$^{1/2}$ sec$^{1/2}$.

13. The sprinkler of claim 1 or 6, wherein the internal passageway includes a central axis and wherein the deflector includes an opening located along the central axis, the opening extending axially entirely through the deflector so as to permit passage of water axially entirely through the deflector along the central axis.

14. The sprinkler of claim 1 or 6, wherein the deflector includes a plate member having a circular outer perimeter with an outer diameter and a plurality of slots extending inwardly from the outer perimeter and axially entirely through the plate member, the slots surrounding a circular slotless central area of the plate member, and the tubular body having a minimum central passageway diameter greater than a maximum diameter of the slotless central area.

15. The sprinkler of claim 14 wherein a ratio of the minimum central passageway diameter to the circular central area diameter is greater than 1.3.

16. The sprinkler of claim 14 wherein a ratio of the minimum central passageway diameter to the circular central area diameter is at least about 1.5.

17. The sprinkler of claim 16, wherein a minimum pressure required for the sprinkler to operate is 40 pounds per square inch gauge or less, and the minimum pressure required for the sprinkler to operate is more than 15 pounds per square inch gauge, and the high-challenge fire hazard includes storage piled up to thirty feet.

18. The sprinkler of claim 1, wherein the internal passageway of the tubular body has a minimum orifice diameter greater than 0.75 inches.

19. The sprinkler of claim 1 or 6, wherein the internal passageway of the tubular body has a minimum orifice diameter greater than 0.85 inches.

20. The sprinkler of claim 19, wherein a minimum pressure required for the sprinkler to operate is 40 pounds per square inch gauge or less, and the minimum pressure required for the sprinkler to operate is more than 15 pounds per square inch gauge, and the high-challenge fire hazard includes storage piled up to thirty feet.

21. The sprinkler of claim 1, wherein the internal passageway of the tubular body has a minimum orifice diameter between 0.75 and 1.2 inches.

22. The sprinkler of claim 1, wherein the deflector includes a shape positioned on a central axis of the internal passageway, at least a portion of the shape having a curved profile with respect to the central axis.

23. The sprinkler of claim 22, wherein the deflector further includes a plate, and the at least a portion of the shape is located between the plate and the discharge end of the generally tubular body.

24. The sprinkler of claim 23, wherein the K factor is between 22 and 26, and the response time index is less than 40 m$^{1/2}$ sec$^{1/2}$.

25. The sprinkler of claim 23, wherein the at least a portion of the shape includes a hemisphere.

26. The sprinkler of claim 25, wherein the K factor is between 22 and 26, and the response time index is less than 40 m$^{1/2}$ sec$^{1/2}$.

27. The sprinkler of claim 25, wherein the hemisphere is contiguous with the plate.

28. The sprinkler of claim 23, wherein the plate is planar with a circular outer perimeter disposed about the central axis, and has at least one slot extending from the circular outer perimeter toward the central axis and axially entirely through the plate, the at least one slot having a width of about one-tenth inch.

29. The sprinkler of claim 28, wherein the K factor is between 22 and 26, and the response time index is less than 40 m$^{1/2}$ sec$^{1/2}$.

30. The sprinkler of claim 1, wherein the deflector includes a hemispheric shape positioned on a central axis of the internal passageway.

31. The sprinkler of claim 30, wherein the K factor is between 22 and 26, and the response time index is less than 40 m$^{1/2}$ sec$^{1/2}$.

32. The sprinkler of claim 1, wherein the deflector includes a nose piece and a plate, the nose piece includes a head portion, the head portion includes a hemispheric shape.

33. The sprinkler of claim 32, wherein the K factor is between 22 and 26, and the response time index is less than 40 m$^{1/2}$ sec$^{1/2}$.

34. The sprinkler of claim 32, wherein the nose piece is disposed between the plate and the discharge end of the generally tubular body, and the nose piece consists of a hemispheric shape.

35. The sprinkler of claim 32, wherein the nose piece is disposed between the plate and the discharge end of the generally tubular body, and the nose piece consists of a hemispheric shape with a bore extending along a central axis of the sprinkler.

36. The sprinkler of any one of claims 1, 10, 7, 6, and 18, wherein a minimum pressure required for the sprinkler to operate is 50 pounds per square inch gauge or less.

37. The sprinkler of claim 36, wherein the minimum pressure required for the sprinkler to operate is more than 15 pounds per square inch gauge.

38. The sprinkler of claim 37, wherein the high-challenge fire hazard includes storage piled up to thirty feet.

39. The sprinkler of claim 38, wherein the high-challenge fire hazard includes storage piled up to forty feet.

40. The sprinkler of claim 37, wherein the minimum pressure required for the sprinkler to operate is more than 15 pounds per square inch gauge.

41. The sprinkler of claim 40, wherein the high-challenge fire hazard includes storage piled up to thirty feet.

42. The sprinkler of claim 41, wherein the high-challenge fire hazard includes storage piled up to forty feet.

43. The sprinkler of claim 41, wherein the minimum pressure required for the sprinkler to operate is more than 15 pounds per square inch gauge.

44. The sprinkler of claim 43, wherein the high-challenge fire hazard includes storage piled up to thirty feet.

45. The sprinkler of any one of claims 1, 10, 7, 6, 18, 24, 26, 29, 31, and 33, wherein a minimum pressure required for the sprinkler to operate is 40 pounds per square inch gauge or less.

46. The sprinkler of any one of claims 1, 10, 7, 6, and 18, wherein a minimum pressure required for the sprinkler to operate is 30 pounds per square inch gauge or less.

* * * * *